US005806148A

United States Patent [19]

McFalls et al.

[11] Patent Number: 5,806,148

[45] Date of Patent: Sep. 15, 1998

[54] TONGUE ASSEMBLY

[75] Inventors: Bob McFalls, Shelby Township; John A. Giampalmi, III, Sterling Heights, both of Mich.

[73] Assignee: TRW Vehicle Safety Systems Inc., Lyndhurst, Ohio

[21] Appl. No.: 858,317

[22] Filed: May 19, 1997

[51] Int. Cl.[6] ..... A44B 11/00

[52] U.S. Cl. ..... 24/168; 24/171; 24/196

[58] Field of Search ..... 24/168, 170, 194, 24/196, 171

[56] References Cited

U.S. PATENT DOCUMENTS

| | | | |
|---|---|---|---|
| 2,845,674 | 8/1958 | Pearson . | |
| 4,876,770 | 10/1989 | Bougher . | |
| 5,050,274 | 9/1991 | Stanisbewski et al. | 24/196 |
| 5,058,244 | 10/1991 | Fernandez . | |
| 5,100,176 | 3/1992 | Bell et al. . | |
| 5,138,749 | 8/1992 | McCune et al. . | |
| 5,222,278 | 6/1993 | Ball et al. . | |
| 5,309,606 | 5/1994 | Kawamura | 24/196 |

*Primary Examiner*—Victor N. Sakran

*Attorney, Agent, or Firm*—Tarolli, Sundheim, Covell, Tummino & Szabo

[57] ABSTRACT

A tongue assembly (10) includes a metal plate member (34) having a first portion (36) with a buckle latch receiving first opening (42) and a second portion (46) offset from the first portion. The metal plate member (34) has a second opening (60) between the first and second portions (36 and 46) through which seat belt webbing (16) extends. The first portion (36) of the metal plate member (34) is positionable on one side of the belt webbing (16). The second portion (46) of the metal plate member (34) is positionable on the other side of the belt webbing (16). A seat belt webbing cinch bar (130) is attached to the metal plate member (34) and located on the other side of the belt webbing (16). The cinch bar (130) has a first position in which the belt webbing (16) is located between the first portion (36) of the metal plate member (34) and the cinch bar (130). The cinch bar (130) is pivotable to a second position in which the belt webbing (16) partially encircles the cinch bar (130) and is clamped by the cinch bar to block relative movement of the cinch bar and the belt webbing. The cinch bar (130) has a first surface portion (144) which engages the belt webbing (16) and effects pivotal movement of the cinch bar to the second position in response to force applied to the first surface portion by the belt webbing.

16 Claims, 2 Drawing Sheets

TONGUE ASSEMBLY

BACKGROUND OF THE INVENTION

1. Technical Field

The present invention relates to a tongue assembly for use in a vehicle seat belt system to help restrain movement of an occupant of a vehicle or of a child seat in a vehicle.

2. Description of the Prior Art

A known vehicle seat belt system is a three-point continuous loop seat belt system. A three-point continuous loop seat belt system includes a seat belt retractor and a length of belt webbing. The belt webbing extends from the retractor through a D-ring fixed to the vehicle and then down to an anchor point near the vehicle floor. A tongue assembly is slidable along the length of belt webbing between the D-ring and the anchor point. To use the seat belt system, a vehicle occupant grasps the tongue assembly and inserts it into a buckle. When the tongue assembly is fastened in the buckle, a portion of the belt webbing extends across the lap of the vehicle occupant and a portion of the belt webbing extends diagonally across the torso of the vehicle occupant. When the tongue assembly is released from the buckle, the belt webbing is wound onto the retractor.

The tongue assembly should slide along the belt when the occupant moves the tongue assembly toward the buckle. The tongue assembly should also slide along the belt after the occupant unlocks the tongue assembly from the buckle so that the retractor can fully wind up the belt. The retractor would otherwise carry the tongue assembly upwardly to the D-ring, whereupon further movement of the belt would be prevented as the D-ring blocked further movement of the tongue assembly. Conversely, when the tongue assembly is locked in the buckle, it should cinch the belt webbing, that is, block movement of the belt webbing through the tongue assembly. This cinching action helps to restrain movement of the vehicle occupant in the event of a vehicle collision, and helps to secure a child seat in position on the vehicle seat. This cinch device is designed to cinch the webbing up to a predetermined load. Loads above the predetermined load may cause the webbing to translate but the occupant is still restrained.

SUMMARY OF THE INVENTION

The present invention is directed to a vehicle occupant safety apparatus. The apparatus comprises a metal plate member having a first portion with a buckle latch receiving first opening and a second portion offset from the first portion. The metal plate member has a second opening between the first and second portions through which seat belt webbing extends. The first portion of the metal plate member is positionable on one side of the seat belt webbing. The second portion of the metal plate member is positionable on the other side of the seat belt webbing. A seat belt webbing cinch bar is attached to the metal plate member and is located on the other side of the seat belt webbing. The cinch bar has a first position in which the seat belt webbing is located between the first portion of the metal plate member and the cinch bar. The cinch bar is pivotable to a second position in which the seat belt webbing partially encircles the cinch bar and is clamped by the cinch bar to block relative movement of the cinch bar and the seat belt webbing. The seat belt webbing cinch bar has a first surface portion which engages the seat belt webbing and effects pivotal movement of the seat belt webbing cinch bar to the second position in response to force applied to the first surface portion by the seat belt webbing.

The tongue assembly is freely slidable along the seat belt webbing when the cinch bar is in the first position. When the tongue assembly is inserted into the buckle, the force from the belt webbing causes the cinch bar to pivot to the second position. The cinch bar, when in the second position, blocks movement in one direction of the belt webbing through the tongue assembly below a predetermined load of about 120 pounds. At loads above 120 pounds, the belt webbing may slip through the tongue assembly.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF PREFERRED EMBODIMENT

The present invention relates to a tongue assembly for use in a vehicle seat belt system for helping to restrain movement of an occupant of the vehicle or of a child seat in the vehicle. The present invention is applicable to various tongue assembly constructions.

Figure 1:
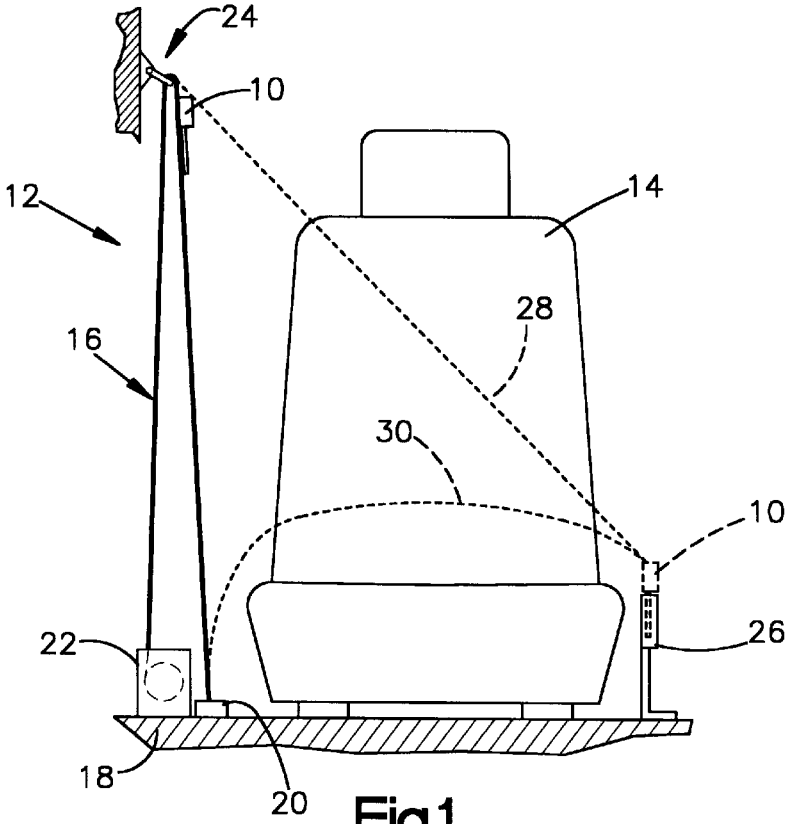
FIG. 1 is a schematic illustration of a vehicle seat belt system including a tongue assembly in accordance with the present invention.

As representative of the present invention, FIG. 1 illustrates a tongue assembly 10. The tongue assembly 10 is incorporated in a three-point continuous loop seat belt system 12 for use in restraining an occupant of a vehicle or a child seat against movement relative to the vehicle. The following description assumes that the seat belt system 12 is used in restraining a vehicle occupant. It should be understood that the invention could be applied to other belt systems.

During operation of the vehicle, the occupant of the vehicle sits on a seat 14 which is illustrated as a front passenger seat in the vehicle. A length of seat belt webbing 16 is extensible about the vehicle occupant. One end of the length of belt webbing 16 is anchored to the vehicle body 18 at an anchor point 20 located on one side of the seat 14. The opposite end of the belt webbing 16 is attached to a seat belt retractor 22 which is secured to the vehicle body on the same side of the seat 14. Intermediate its ends, the belt webbing 16 passes through the tongue assembly 10 and a D-ring 24 that is located above the retractor 22 and the anchor point 20. When the seat belt system 12 is not in use, or is in its stowed condition, the belt webbing 16 is wound on the retractor 22 and is oriented generally vertically on the one side of the seat 14, as shown in solid lines in FIG. 1.

To engage the seat belt system 12, the tongue assembly 10 is manually grasped and is pulled across the lap and torso of the occupant sitting in the seat 14. As the tongue assembly 10 is pulled across the lap and torso of the occupant, the tongue assembly moves along the belt webbing 16, and the belt webbing is unwound from the retractor 22. When the belt webbing 16 has been pulled across the lap and torso of the occupant, the tongue assembly 10 is connected with a buckle 26 as shown in dashed lines in FIG. 1. The buckle 26 is connected to the vehicle body 18 and is disposed on the side of the seat 14 opposite the anchor point 20. When the seat belt system 12 is thus buckled, the length of belt webbing 16 is divided by the tongue assembly 10 into a torso portion 28 which extends across the torso of the occupant and a lap portion 30 which extends across the lap of the occupant.

The tongue assembly 10 (FIGS. 2–5) includes a metal plate member 34 which is preferably made of heat treated and chrome plated steel. The plate member 34 is a single piece of stamped metal and includes a generally planar leading end portion 36. The leading end portion 36 of the plate member 34 extends along a first plane 38 (FIG. 3). An opening 42 (FIG. 2) in the leading end portion 36 of the plate member 34 forms a buckle latch receiving opening in the tongue assembly 10. The opening 42 may have various designs. An optional opening 40 may be formed in the plate member 36 to reduce the weight of the tongue assembly 10.

The plate member 34 includes a generally planar trailing end portion 46 which extends along a second plane 48 (FIG. 3). The second plane 48 is generally parallel to and offset from the first plane 38. As a result, the trailing end portion 46 of the plate member 34 is generally parallel to and offset from the leading end portion 36 of the plate member.

A connector portion 50 (FIG. 2) of the plate member 34 extends at an angle between, and interconnects, the leading end portion 36 and trailing end portion 46 of the plate member. The connector portion 50 includes parallel, spaced apart first and second arm portions 54 and 56. The arm portions 54 and 56 lie in a connector plane which extends at an angle between the first plane 38 and the second plane 48.

The leading end portion 36, the trailing end portion 46, the first arm portion 54, and the second arm portion 56 of the plate member 34 define a first belt webbing opening 60 in the tongue assembly 10. The first belt webbing opening 60 is disposed between the leading end portion 36 and the trailing end portion 46 of the plate member 34. The first belt webbing opening 60 has an area in the connector plane which is sufficient to enable the belt webbing 16 (FIG. 3) to pass freely through the first belt webbing opening.

The tongue assembly 10 also includes a body 70 of plastic material which covers most of the plate member 34 and which has portions located in the first belt webbing opening 60. The body 70 of plastic material is molded from nylon, preferably Zytel® (trademark of E. I. Dupont de Nemours & Co.) brand plastic. The body 70 of plastic material is insert molded as one piece on the metal plate member 34 by a known process.

The body 70 of plastic material includes a leading end portion 76 which covers a part of the leading end portion 36 of the plate member 34. The leading end portion 76 of the body 70 of plastic material has first and second major side surfaces 78 and 80 spaced apart generally an equal distance on opposite sides of the first plane 38.

The leading end portion 76 of the body 70 of plastic material has a first webbing guiding surface 84. The first webbing guiding surface 84 is planar and extends in a plane which is skewed at an angle of about 6° with respect to the first plane 38. A first arcuate connector surface 86 extends between and interconnects the first webbing guiding surface 84 and the first major side surface 78 of the leading end portion 76 of the body 70 of plastic material.

The leading end portion 76 of the body 70 of plastic material also has a planar clamping surface 90. The planar clamping surface 90 extends transversely to the first webbing guiding surface 84 at an angle of about 55° with respect to the first plane 38. A second arcuate connector surface **86*a* extends between and interconnects the clamping surface 90 and the second major side surface 80 of the leading end portion 76 of the body 70 of plastic material. The clamping surface 90 and the second arcuate connector surface 86*a* interconnect the first webbing guiding surface 84 with the second major side surface 80 of the leading end portion 76 of the body 70** of plastic material.

The body 70 of plastic material also includes a trailing end portion 96 which covers the trailing end portion 46 of the plate member 34. The trailing end portion 96 of the body 70 of plastic material has first and second major side surfaces 98 and 100 spaced apart on opposite sides of the second plane 48. An arcuate, concave support surface 104 extends from the second major side surface 100 of the trailing end portion 96 in a direction toward the first major side surface 98 of the trailing end portion 96. The support surface 104 has a center of curvature located on a central axis 106 of the tongue assembly 10.

A planar second webbing guiding surface 110 extends from the first major side surface 98 of the trailing end portion 96 in a direction toward the second major side surface 100 of the trailing end portion 96. The second webbing guiding surface 110 lies in a plane which is skewed with respect to the second plane 48 and also with respect to the first webbing guiding surface 84.

A planar connecting surface 112 extends transversely between, and interconnects, the second webbing guiding surface 110 and the support surface 104. The connecting surface 112 is generally parallel to, and spaced apart from, the planar clamping surface 90 of the leading end portion 76 of the body 70 of plastic material.

The clamping surface 90, the first webbing guiding surface 84, and the connector surfaces 86 and **86*a* of the leading end portion 76, and the support surface 104, the second webbing guiding surface 110, and the connecting surface 112 of the trailing end portion 76, together partially define a second belt webbing opening 116 in the body 70 of plastic material. The second belt webbing opening 116 is disposed between the leading end portion 76 and the trailing end portion 96 of the body 70 of plastic material. The second belt webbing opening 116 has an area which is smaller than that of the first belt webbing opening 60 but is sufficient to enable the belt webbing 16** to pass freely through the second belt webbing opening.

Figure 2:
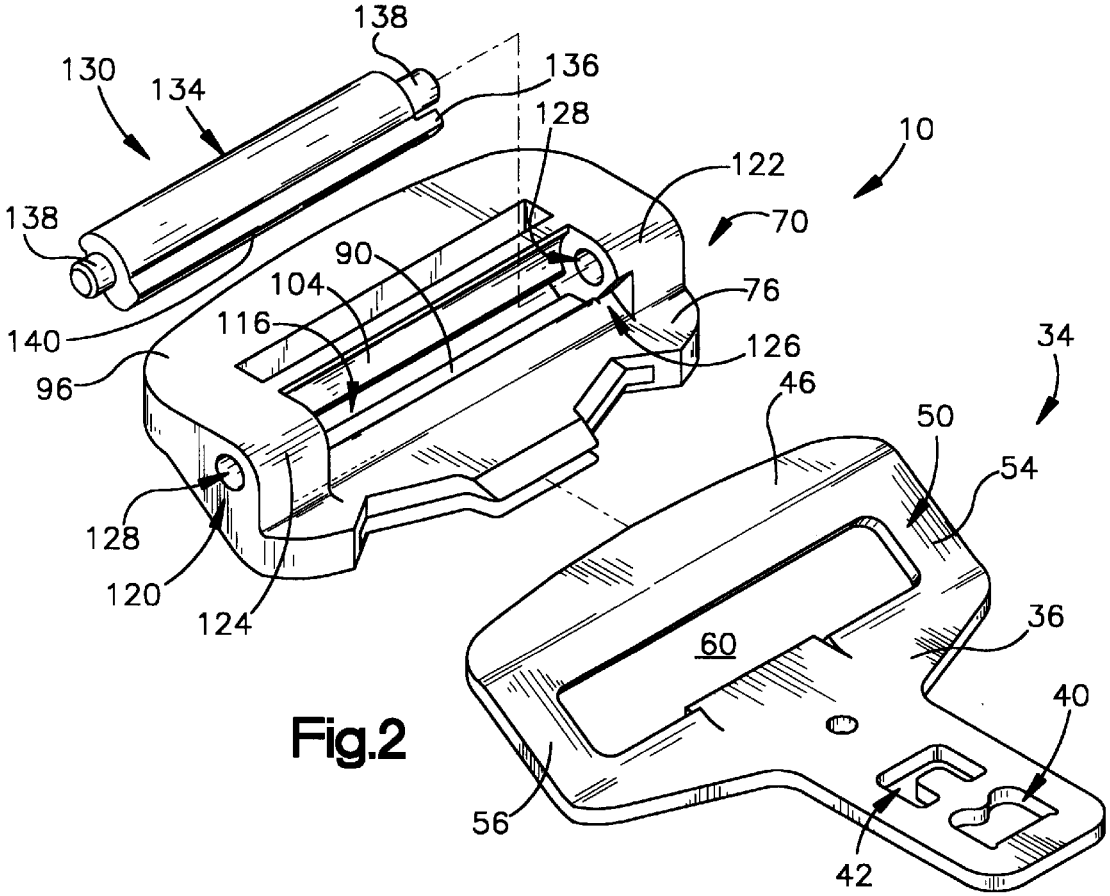
FIG. 2 is an exploded perspective view of the tongue assembly of FIG. 1.
Figure 5:
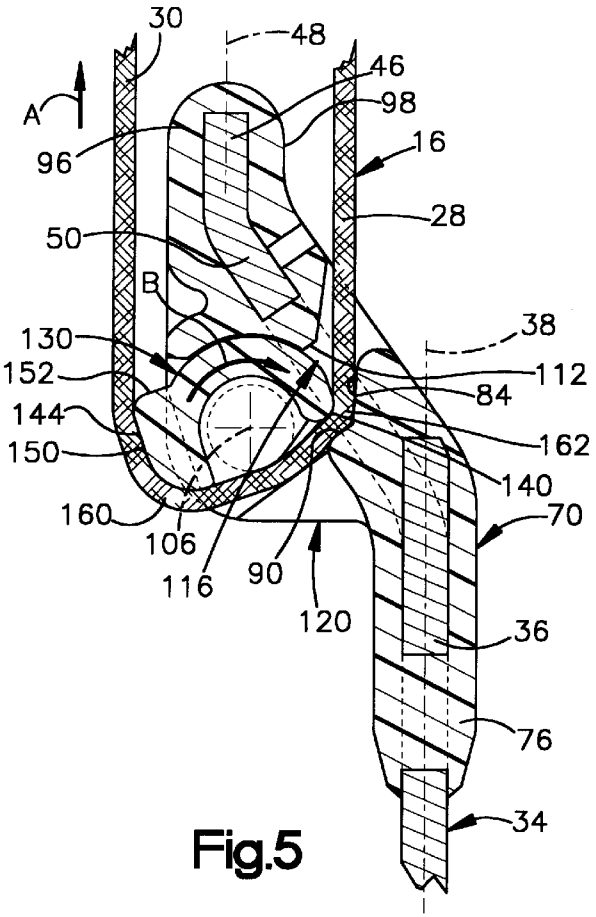
FIG. 5 is a view similar to FIG. 4 showing parts of the tongue assembly of FIG. 3 in yet another position.
Figure 3:
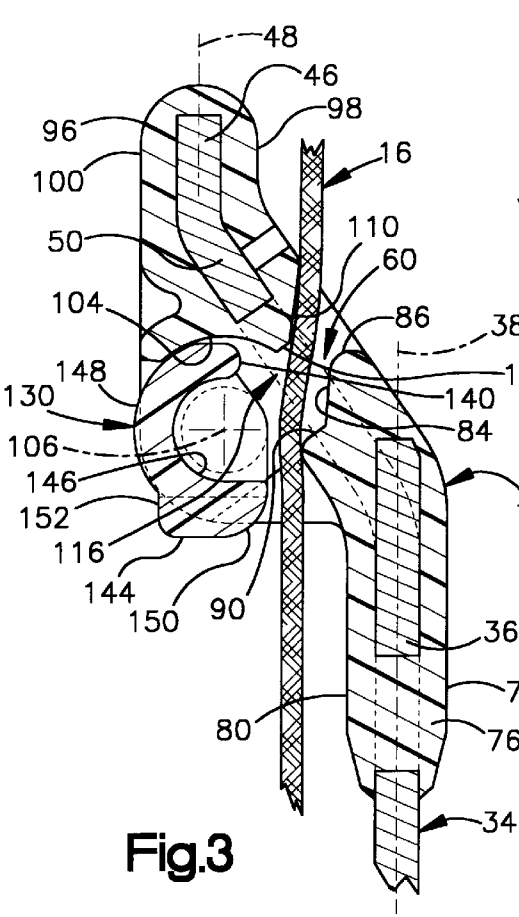
FIG. 3 is a side sectional view of the tongue assembly of FIG. 2 in an assembled condition.

The body 70 of plastic material also includes a connector portion 120 (FIGS. 2 and 5). The connector portion 120 includes spaced apart first and second arm portions 122 and 124 (FIG. 2) which cover the first and second arm portions 54 and 56, respectively, of the plate member 34. The first arm portion 122 includes a notch 126 (FIG. 2) presented toward the second arm portion 124. Each of the arm portions 122 and 124 of the connector portion 120 of the body 70 of plastic material includes a cylindrical opening 128.

The tongue assembly 10 includes a cinch bar 130 (FIGS. 2 and 3). The cinch bar 130 includes an axially extending body portion 134 and a pair of pivot pins 138 extending axially from opposite ends of the body portion 134. The pivot pins 138 are disposed in the cylindrical openings 128 in the body 70 of plastic material. The pivot pins 138 support the cinch bar 130 for pivotal movement about the central axis 106. A projection key portion 136 of the cinch bar 130 extends axially from one end of the cinch bar and has a shape complementary to the notch 126.

The cinch bar 130 is preferably molded from Acetal® (trademark of Celenese Plastic Corp.) brand plastic. The cinch bar 130 is preferably molded as one piece of plastic but may alternatively be formed as two pieces (not shown) with the body portion 134 having a central longitudinal opening for receiving a separate pivot pin which may be made of another material.

The body portion 134 of the cinch bar 130 (FIG. 3) includes an arcuate belt webbing clamping surface 140 and a cinch bar actuation surface 144. An arcuate inner side surface 146 and an arcuate outer side surface 148, having centers of curvature on the central axis 106, extend between and interconnect the belt webbing clamping surface 140 and the cinch bar actuation surface 144. A plurality of radially extending ribs (not shown) are spaced apart at intervals over the length of the cinch bar body portion 134. Each rib has the cross-sectional configuration of the body portion 134 as a whole. The cinch bar 130 is molded in this manner in accordance with known molding practices.

The cinch bar actuation surface 144 includes a curved belt webbing engaging surface 150 extending from the inner side surface 146 towards the outer side surface 148. The cinch bar actuation surface 144 also includes a planar stop surface 152 which extends between and interconnects the belt webbing engaging surface 150 and the arcuate outer side surface 148 of the cinch bar 130. The radial distance between the stop surface 152 and the central axis 106 is greater than the radial distance between the arcuate outer side surface 148 and the central axis.

FIG. 3 illustrates the parts of the tongue assembly 10 in an unlocked or free-running condition. The belt webbing 16 of the seat belt system 12 (FIG. 1) is in its stowed condition and the tongue assembly 10 is adjacent the D-ring 24. The belt webbing 16 extends through the tongue assembly 10 in a relatively straight condition. The cinch bar 130 is in a first position or first condition of rotation about the central axis 106 in which the belt webbing 16 is located between the leading end portions 36 and 76 of the plate member 34 and the body 70 of plastic material, respectively, and the cinch bar 130, as shown in FIG. 3. When the cinch bar 130 is in the first condition, the belt webbing clamping surface 140 of the cinch bar is spaced apart from the clamping surface 90 of the body 70 of plastic material by a first distance.

To engage the seat belt system 12 (FIG. 1), the vehicle occupant engages the leading end portion 36 of the plate member 34 of the tongue assembly 10 with the buckle 26. The vehicle occupant then pulls upward on the torso portion 28 of the belt webbing 16 until enough of the belt webbing passes through the tongue assembly 10 to make the lap portion 30 fit tightly around the occupant's lap. The vehicle occupant then releases the torso portion 28 of the belt webbing 16. The seat belt system 12 is then in the buckled condition as shown in dashed lines in FIG. 1.

Figure 4:
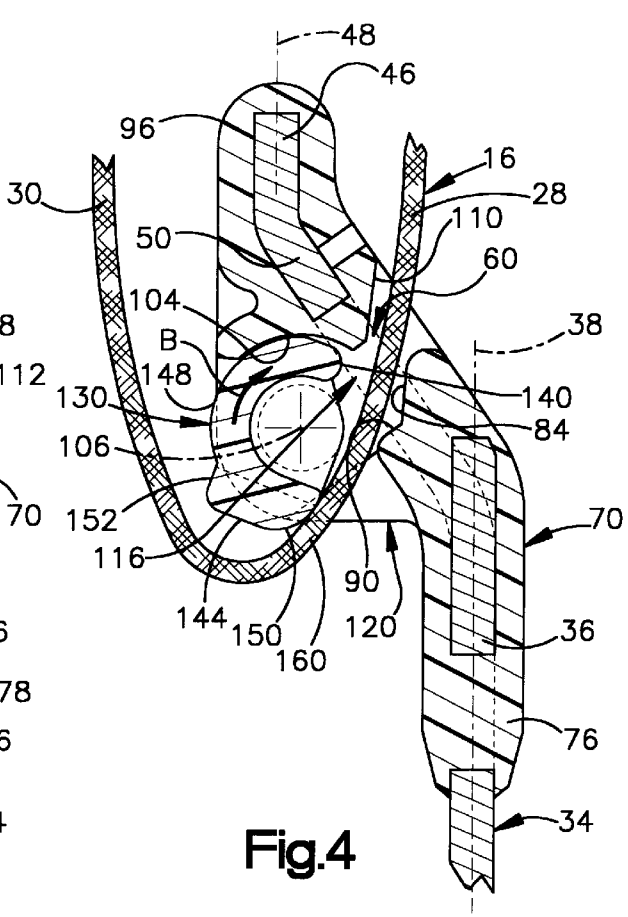
FIG. 4 is a view similar to FIG. 3 showing parts of the tongue assembly in a different position.

As the seat belt system 12 is moved into the buckled condition, the belt webbing 16 partially wraps around, or encircles, the cinch bar 130 and assumes a U-shape within the tongue assembly 10, as seen sequentially in FIGS. 4 and 5. Both the lap portion 30 and the torso portion 28 of the belt webbing 16 extend from the cinch bar 130 of the tongue assembly 10, in an upward direction as viewed in FIG. 5. The lap portion 30 of the belt webbing 16 is tight around the occupant's lap. The tensile force on the lap portion 30 of the belt webbing 16 acts in the direction indicated by the arrow A in FIG. 5. The torso portion 28 of the belt webbing 16 is also under tension from a retraction force applied by the retractor 22.

As the belt webbing 16 wraps around the cinch bar 130, a first portion 160 of the belt webbing 16 frictionally engages the belt webbing engaging surface 150 of the cinch bar 130. The first portion 160 of the belt webbing 16 transfers force from the belt webbing to the cinch bar 130. This eccentric force causes the cinch bar 130 to pivot in a direction indicated by the arrow B, that is, clockwise as viewed in FIGS. 3–5. The support surface 104 of the body 70 of plastic material helps to guide the pivotal movement of the cinch bar 130 and supports the cinch bar under high loads.

As the cinch bar 130 pivots in the direction B, the belt webbing clamping surface 140 frictionally engages a second portion 162 of the belt webbing 16 and, together with the second portion of the belt webbing, moves toward the leading end portion 76 of the tongue along an arcuate path having a center of curvature on the central axis 106. The cinch bar pivots in the direction B until the clamping force exerted on the belt webbing 162 by the clamping surfaces 90 and 140 balances the pivoting force applied to the cinch bar surface 150.

The cinch bar 130 is then in a second position as shown in FIG. 5. When the cinch bar 130 is in the second position, the belt webbing clamping surface 140 of the cinch bar is spaced from the clamping surface 90 of the body 70 of plastic material by a second distance, which is less than the first distance. The belt webbing clamping surface 140 of the cinch bar 130 clamps the second portion 162 of the belt webbing 16 against the clamping surface 90 of the body 70 of plastic material on the tongue assembly 10.

The clamping of the belt webbing 16 against the clamping surface 90 of the body 70 of plastic material blocks movement of the belt webbing 16 through the tongue assembly 10 in the direction indicated by the arrow A in FIG. 5. Thus, the belt webbing 16 is clamped by the cinch bar 130 in the tongue assembly 10, and the lap portion 30 of the belt webbing cannot normally be lengthened. This helps to restrain movement of an occupant of the seat 14.

The force applied to the lap portion 30 of the belt webbing 16 may be increased substantially if the vehicle decelerates suddenly and the vehicle occupant's momentum causes the occupant to move forward relative to the seat 14. The parts of the tongue assembly 10 can be configured so that, if this occurs, the belt webbing 16 may slip through the tongue assembly to balance the load on the torso portion 28 and the lap portion 30 of the seat belt system 12. This may happen if the force on the belt webbing 16 exceeds a predetermined level, for example, about 120 pounds.

When the vehicle occupant unbuckles the seat belt system 12, the tension on the lap portion 30 of the belt webbing 16 is released. The retractor 22 pulls on the belt webbing 16 and winds belt webbing on the retractor 22 to return the seat belt system 12 to the stowed condition as shown in FIG. 1. The retractor 22 also pulls the belt webbing 16 through the tongue assembly 10 in the direction opposite that indicated by the arrow A in FIG. 5. The tongue assembly returns to its unlocked condition and the cinch bar pivots back to the first position shown in FIG. 3.

The foregoing description assumes that the seat belt system 12 (FIG. 1) is used for restraining a vehicle occupant in the seat 14. As noted above, the seat belt system 12 (FIG. 1) can also be used for restraining a child seat (not shown) in the seat 14. The seat belt system 12, when used for restraining a child seat in the seat 14, is buckled so that the lap portion 30 of the belt webbing 16 holds the child seat on the vehicle seat 14. The tongue assembly 10 clamps the seat belt webbing 16 so that the lap portion 30 of the belt webbing can not be lengthened. Thus, the child seat is securely held in position on the vehicle seat 14 and does not move relative to the child seat during vehicle maneuvering.

From the above description of the invention, those skilled in the art will perceive improvements, changes and modifications in the invention. For example, the configuration of the body of plastic material may be altered from the free-falling configuration illustrated to a free-running configuration. Such improvements, changes and modifications within the skill of the art are intended to be covered by the appended claims.

Having described the invention, we claim:

1. Apparatus comprising:

a metal plate member having a first portion having a buckle latch receiving first opening and a second portion offset from said first portion, said metal plate member having a second opening between said first and second portions through which seat belt webbing extends, the first portion of said metal plate member being positionable on one side of the seat belt webbing and the second portion of said metal plate member being positionable on the other side of the seat belt webbing;

a seat belt webbing cinch bar attached to said metal plate member and located on said other side of the seat belt webbing, said cinch bar being pivotable between a first position in which the seat belt webbing is located between said first portion of said metal plate member and said cinch bar and a second position in which said seat belt webbing partially encircles said cinch bar and is clamped by said cinch bar to block relative movement of the cinch bar and the seat belt webbing; and said seat belt webbing cinch bar having a first surface portion which engages the seat belt webbing and effects pivotal movement of said seat belt webbing cinch bar to said second position in response to force applied to said first surface portion by the seat belt webbing;

said cinch bar having a second surface portion for engaging and clamping said seat belt webbing;

said second surface portion travels in an arcuate path upon movement of said cinch bar between said first position and said second position; and further comprising a third surface portion, said seat belt webbing being clamped between and engaged by said second surface portion and said third surface portion when said cinch bar is in said second position.

2. Apparatus as defined in claim 1 wherein said second surface portion on said cinch bar is spaced apart from said third surface portion by a first distance when said cinch bar is in said first position and by a second distance, smaller than said first distance, when said cinch bar is in said second position.

3. Apparatus as defined in claim 2 wherein said cinch bar is supported for pivotal movement by a body of material secured to said metal plate member.

4. Apparatus as defined in claim 3 wherein said body of material is plastic.

5. Apparatus as defined in claim 4 wherein said body of material includes spaced apart cylindrical openings and said cinch bar comprises an axially extending body portion having a pair of pins, each one of said pins extending axially from an opposite end of said body portion and being supported in a respective one of said cylindrical openings to support said cinch bar for pivotal movement between said first and second positions.

6. Apparatus as defined in claim 5 wherein said cinch bar has a pair of spaced apart arcuate surface portions extending between and connecting said first surface portion and said second surface portion.

7. Apparatus comprising:

a metal plate member having a buckle latch receiving first opening, said metal plate member having a second opening through which seat belt webbing extends;

a body of plastic material fixedly secured to said metal plate member and partially located in said second opening, said body of plastic material having a third opening through which the seat belt webbing extends;

a pivotal seat belt webbing cinch bar having a first position in which the seat belt webbing is not clamped by said cinch bar to said body of plastic material and a second position in which said seat belt webbing is clamped by said cinch bar against said body of plastic material to block relative movement of the body of plastic material and the seat belt webbing; and said cinch bar having a first surface portion which engages the seat belt webbing and effects pivotal movement of said cinch bar to said second position in response to force applied to said first surface portion by the seat belt webbing;

said metal plate has a first portion lying in a first plate and defining said first opening, a second portion lying in a second plane spaced apart from said first plate and an intermediate portion interconnecting said first and second portions and having said second opening;

said cinch bar has a second surface portion for engaging and clamping said seat belt webbing;

said second surface portion travels in an arcuate path upon movement of said cinch bar between said first position and said second position; and said body of plastic material includes a third surface portion, said seat belt webbing being clamped between and engaged by said second surface portion and said third surface portion when said cinch bar is in said second position.

8. Apparatus as defined in claim 7 wherein said second surface portion on said cinch bar is spaced apart from said third surface portion on said body of plastic material by a first distance when said cinch bar is in said first position and by a second distance, smaller than said first distance, when said cinch bar is in said second position.

9. Apparatus as defined in claim 8 wherein said cinch bar has a pair of spaced apart arcuate surface portions extending between and connecting said first surface portion and said second surface portion.

10. Apparatus comprising:

a metal plate member having a first portion lying in a first plane and having a buckle latch receiving first opening and a second portion lying in a second plane offset from said first portion, said metal plate member having a second opening between said first and second portions through which seat belt webbing extends, the first portion of said metal plate member being positionable on one side of the seat belt webbing and the second portion of said metal plate member being positionable on the other side of the seat belt webbing;

a seat belt webbing cinch bar attached to said metal plate member and located on said other side of the seat belt webbing, said cinch bar being pivotable between a first position in which the seat belt webbing is located between said first portion of said metal plate member and said cinch bar and a second position in which said seat belt webbing partially encircles said cinch bar and is clamped by said cinch bar to block relative movement of the cinch bar and the seat belt webbing; and said seat belt webbing cinch bar having a first surface portion, said first surface portion being engaged by the seat belt webbing and said first surface portion receiving force from said seat belt webbing to effect pivotal movement of said seat belt webbing cinch bar to said second position.

11. Apparatus as defined in claim 10 wherein said cinch bar has a second surface portion for engaging and clamping said seat belt webbing.

12. Apparatus as defined in claim 11 wherein said second surface portion travels in an arcuate path upon movement of said cinch bar between said first position and said second position.

13. Apparatus comprising:

a metal plate member having a buckle latch receiving first opening, said metal plate member having a second opening through which seat belt webbing extends;

a body of plastic material fixedly secured to said metal plate member and partially located in said second opening, said body of plastic material having a third opening through which the seat belt webbing extends;

a pivotal seat belt webbing cinch bar having a first position in which the seat belt webbing is not clamped by said cinch bar to said body of plastic material and a second position in which said seat belt webbing is clamped by said cinch bar against said body of plastic material to block relative movement of the body of plastic material and the seat belt webbing; and said seat belt webbing cinch bar having a first surface portion, said first surface portion being engaged by the seat belt webbing and said first surface portion receiving force from said seat belt webbing to effect pivotal movement of said seat belt webbing cinch bar to said second position.

14. Apparatus as defined in claim 13 wherein said metal plate has a first portion lying in a first plane and defining said first opening, a second portion lying in a second plane spaced apart from said first plane and an intermediate portion interconnecting said first and second portions and having said second opening.

15. Apparatus as defined in claim 14 wherein said cinch bar has a second surface portion for engaging and clamping said seat belt webbing.

16. Apparatus as defined in claim 15 wherein said second surface portion travels in an arcuate path upon movement of said cinch bar between said first position and said second position.

* * * * *